US007954782B2

(12) United States Patent
Harralson et al.

(10) Patent No.: US 7,954,782 B2
(45) Date of Patent: Jun. 7, 2011

(54) PICTURE HANGING POSITION FINDER AND WALL MARKING DEVICE

(76) Inventors: Benjamin Simpson Harralson, Louisville, KY (US); Mary Stacey Harralson, Louisville, KY (US)

( * ) Notice: Subject to any disclaimer, the term of this patent is extended or adjusted under 35 U.S.C. 154(b) by 0 days.

(21) Appl. No.: 11/893,083

(22) Filed: Aug. 14, 2007

(65) Prior Publication Data

US 2009/0045315 A1 Feb. 19, 2009

(51) Int. Cl.
*A47F 1/14* (2006.01)
*A47G 1/16* (2006.01)
*B60R 1/02* (2006.01)

(52) U.S. Cl. ..... 248/469; 248/354.1; 248/354.6

(58) Field of Classification Search .... 248/354.1–354.7, 248/469–474

See application file for complete search history.

(56) References Cited

U.S. PATENT DOCUMENTS

| | | | | | |
|---|---|---|---|---|---|
| 139,726 | A * | 6/1873 | Miller | 182/112 |
| 496,739 | A * | 5/1893 | Kennedy | 254/100 |
| 1,715,603 | A * | 6/1929 | Kamman | 211/85.4 |
| 3,516,165 | A | 6/1970 | Pfeffer | |
| 3,583,743 | A * | 6/1971 | Newell | 292/339 |
| 3,778,625 | A * | 12/1973 | Schwartz et al. | 378/180 |
| 4,141,612 | A * | 2/1979 | Rowe | 312/245 |
| 4,455,756 | A | 6/1984 | Greene | |
| 4,976,409 | A | 12/1990 | Hansen | |
| 5,180,135 | A | 1/1993 | Hindall | |
| 5,642,820 | A | 7/1997 | Angeles | |
| 5,915,656 | A * | 6/1999 | Grewe | 248/150 |
| 6,049,991 | A | 4/2000 | Gruenberg et al. | |
| 6,212,810 | B1 * | 4/2001 | Jones | 40/757 |
| 6,226,881 | B1 * | 5/2001 | Landauer | 33/515 |
| 6,585,218 | B1 | 7/2003 | Friberg | |
| 6,612,533 | B2 * | 9/2003 | Biles et al. | 248/354.1 |
| 6,957,797 | B1 * | 10/2005 | Strobel | 248/477 |
| 7,566,042 | B1 * | 7/2009 | Yates | 248/466 |
| 2003/0051363 | A1 * | 3/2003 | Hofmeister et al. | 33/613 |
| 2003/0229999 | A1 * | 12/2003 | Rimback | 33/613 |
| 2006/0231721 | A1 * | 10/2006 | Robic | 248/497 |
| 2007/0164184 | A1 * | 7/2007 | Xammar Bove | 248/354.1 |

* cited by examiner

*Primary Examiner* — Terrell McKinnon
*Assistant Examiner* — Michael McDuffie
(74) *Attorney, Agent, or Firm* — Carrithers Law Office, PLLC; David W. Carrithers

(57) ABSTRACT

Picture Hanging Position Finder And Wall Marking Device has an elongated adjustable vertical support with a hanger at the top to accept and hold a wire or bracket for a framed picture or other hanging object, wherein the device may lean against a wall with the back of the vertical support held flush against the wall, and with the bottom of the vertical support elevated above any wall baseboard, and held in place by forward and laterally extending legs which reach down to a horizontal floor. As such, a picture can be suspended from the vertical support, and the device can be moved to any location against a wall, and the height can adjusted and locked in place, so that a user may view the picture from a distance as if it were hung on the wall in order to choose a desirable location for the picture. The device then has a means for marking the wall for the installation of a permanent hanger at the precise location from where the picture had been temporarily suspended.

17 Claims, 7 Drawing Sheets

PICTURE HANGING POSITION FINDER AND WALL MARKING DEVICE

BACKGROUND OF THE INVENTION

This invention relates to a vertically adjustable floor standing support structure designed for temporarily holding a framed picture, mirror or other hanging object against a wall so that the user can view the object in various locations in order to find the most desirable location, and including a means for marking the wall at the precise position where a permanent hanger should be installed.

The word "picture" will be used herein to generally describe a framed picture, mirror, or other hanging object or display that one may wish to hang on a wall. The phrase "permanent hanger" is used herein to generally describe a nail, screw, hanger, or other device installed in a wall from which a picture is suspended.

In order to hang a picture on a wall, one must first choose a location where the picture will hang. To locate the most desirable location for a picture to hang, it is often necessary to enlist the help of another person to hold the picture place in various locations and positions on various walls so that the picture may be viewed from a distance. This requires some effort on the part of the person holding the picture, and that person is invariably partially blocking the view of the picture and surrounding wall for the person viewing.

Once a desirable location for the picture has been chosen, it must be determined exactly where on the wall one or more permanent hangers must be installed on which to hang the picture. This often requires marking the wall at the top of the picture frame and measuring the distance between the top of the frame and the wire or bracket which holds the frame. If the permanent hanger is installed in the wrong location then it may have to be repositioned, causing unnecessary damage to the wall.

SUMMARY OF THE INVENTION

It is therefore an object of this invention to provide a mobile and vertically adjustable support which extends up from a floor to temporarily hold a picture in place on a wall so that the user can experiment with different locations in order to find the most desirable location for the picture to be permanently hung.

It is a further object of this invention to provide a means for marking the precise location where a permanent hanger should be installed in the wall so that the picture will hang in the chosen position on the wall, without the need for taking measurements or otherwise marking the wall.

Briefly described according to one illustrative embodiment thereof, the device is comprised of a rigid elongated vertical support having a hanger such as a hook or screw affixed on its front near the top, which will accept and hold a horizontal wire or a bracket affixed to the back of a picture. The device is designed to lean against a wall opposite two legs wherein the vertical support will be held upright and flush against the wall. The bottom of the vertical support is held raised above the floor, such that it will not be obstructed by any baseboard along the wall. The vertical support is held in place upright, raised, and against the wall, by the two legs which extend out from the bottom of the support laterally and in a forward direction away from the wall, before curving down to the floor.

With the vertical support in place standing on the legs and against a wall, a picture can be suspended from the hanger at the top of the vertical support. The vertical support can then be adjusted to a desired height and locked into place at the chosen height. The picture is thereby held in position on the wall for experimental viewing by the user.

Once the location for the picture is chosen, the user can remove the picture from the device with the device remaining in position on the wall. The hanger from which the picture had been suspended is now directly in front of the location on the wall where a permanent hanger should be installed. As such, the hanger becomes a reference point for where the wall should be marked. Using this principle, the device has a means for marking the wall in the precise position of the hanger from which the picture was suspended. In one embodiment of the marking mechanism, the hanger on the vertical support is a screw which can be pushed or tapped with a hammer from the front, causing the opposite sharp end of the screw to break the surface of the wall marking the precise location for the permanent hanger.

BRIEF DESCRIPTION OF THE DRAWINGS

This invention will be described hereafter in the Detailed Description, taken in conjunction with the following drawings, in which like elements are identified with like numbers, and in which.

DETAILED DESCRIPTION

Figure 1:
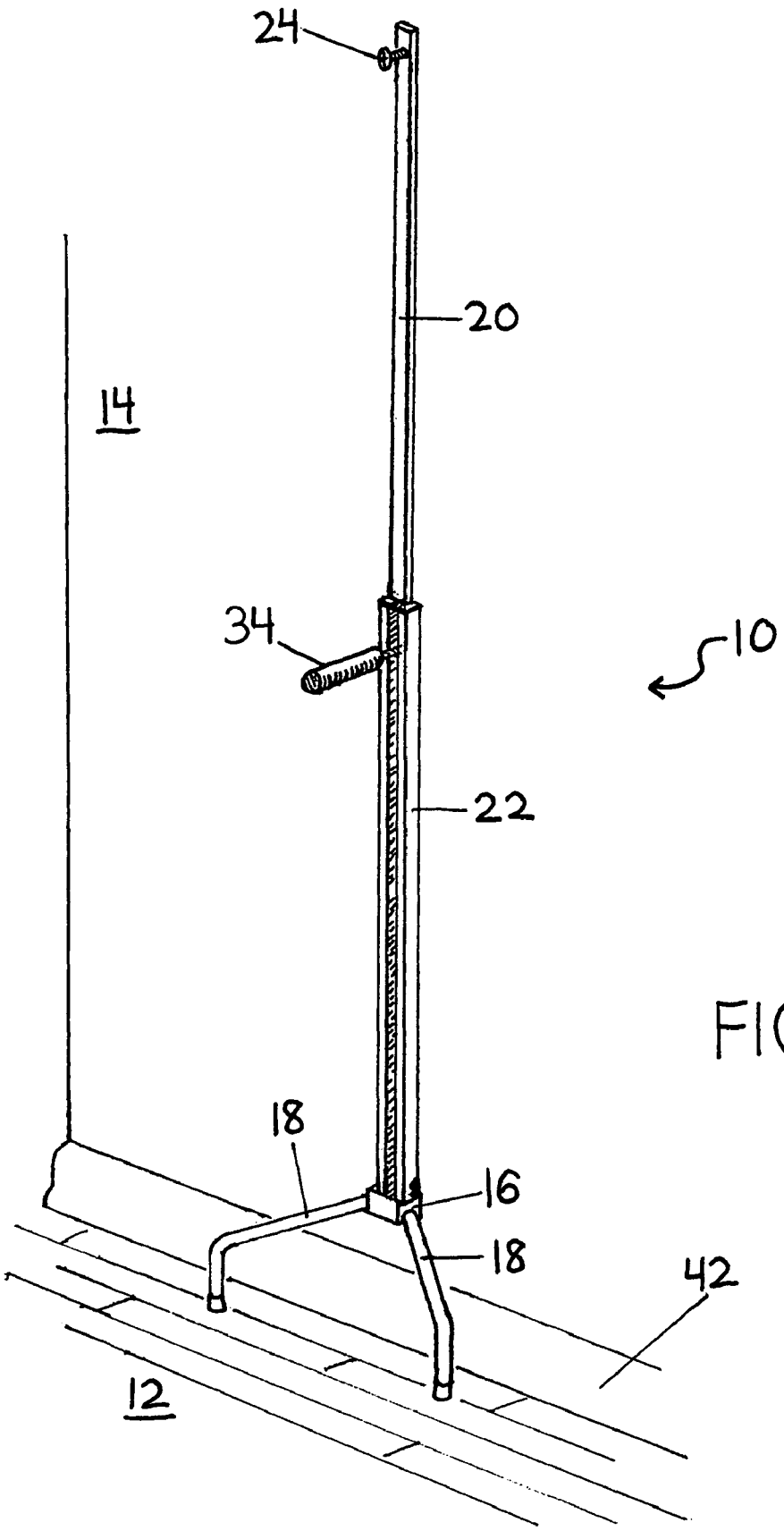
FIG. 1 is a perspective view of the described embodiment of the picture hanging device showing the device standing upright on a floor and leaning against a wall with the vertical support locked in a raised position.
Figure 2:
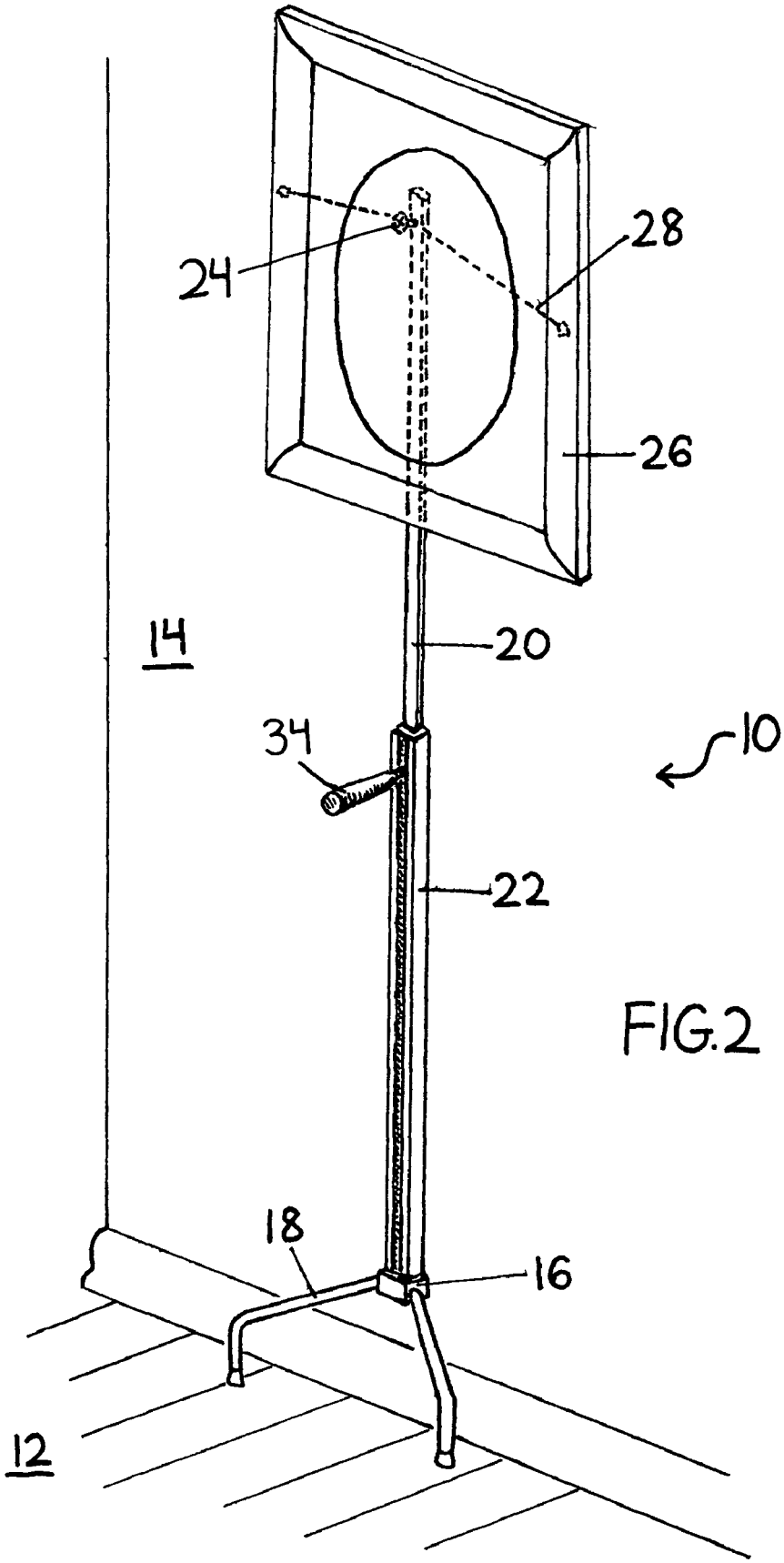
FIG. 2 is a perspective view of the device showing the device supporting a framed picture. The portion of the vertical support hidden by the picture is shown in phantom, as is the wire affixed to the back of the picture frame.

Referring to the drawings, FIG. 1 illustrates an embodiment of the picture hanging device constructed according to this invention and designated generally by the reference number 10. FIG. 1 shows the device in an upright orientation standing on a horizontal floor 12, and leaning back against a vertical wall 14. As shown, the device consists of a rigid elongated vertical support held upright by a base 16 with two legs 18 which extend laterally and forward down to the floor. The top portion of the vertical support contains a screw 24 which serves as a hanger from which a picture can be suspended. FIG. 2 shows the device with a framed picture 26 suspended from the hanger (the hidden portion of the vertical support and picture frame wire 28 are shown in phantom).

Figure 7:
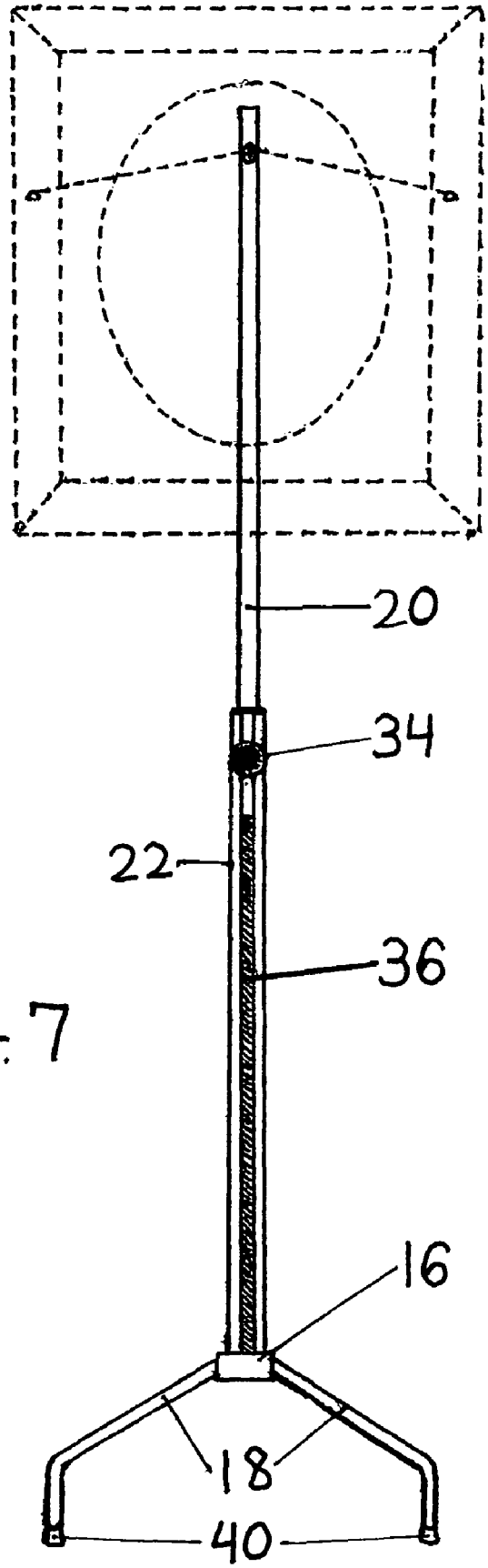
FIG. 7 is a frontal view of the device standing with a framed picture suspended by a wire from the hanger on the vertical support. The framed picture and wire are shown in phantom.

The vertical support is made up of two parts, an upper member 20, and a lower member 22. The lower member forms a track or housing in which the upper member can slide, allowing the upper member to be raised and lowered for adjusting the height of the vertical support. As illustrated in the drawings including FIG. 2, a handle 34 is affixed to the lower portion of the upper member which remains with the lower member when raised. The handle can be gripped and used to adjust the height of the vertical support. The lower member has an opening 36 along its front face which allows the handle to protrude out and to slide vertically along with the upper member. FIG. 7 is a frontal view of the device which shows that the handle 34 is attached near the bottom of the upper member so that it will not obstruct a picture suspended from the hanger 24 at the top of the upper member 20.

Figure 3:
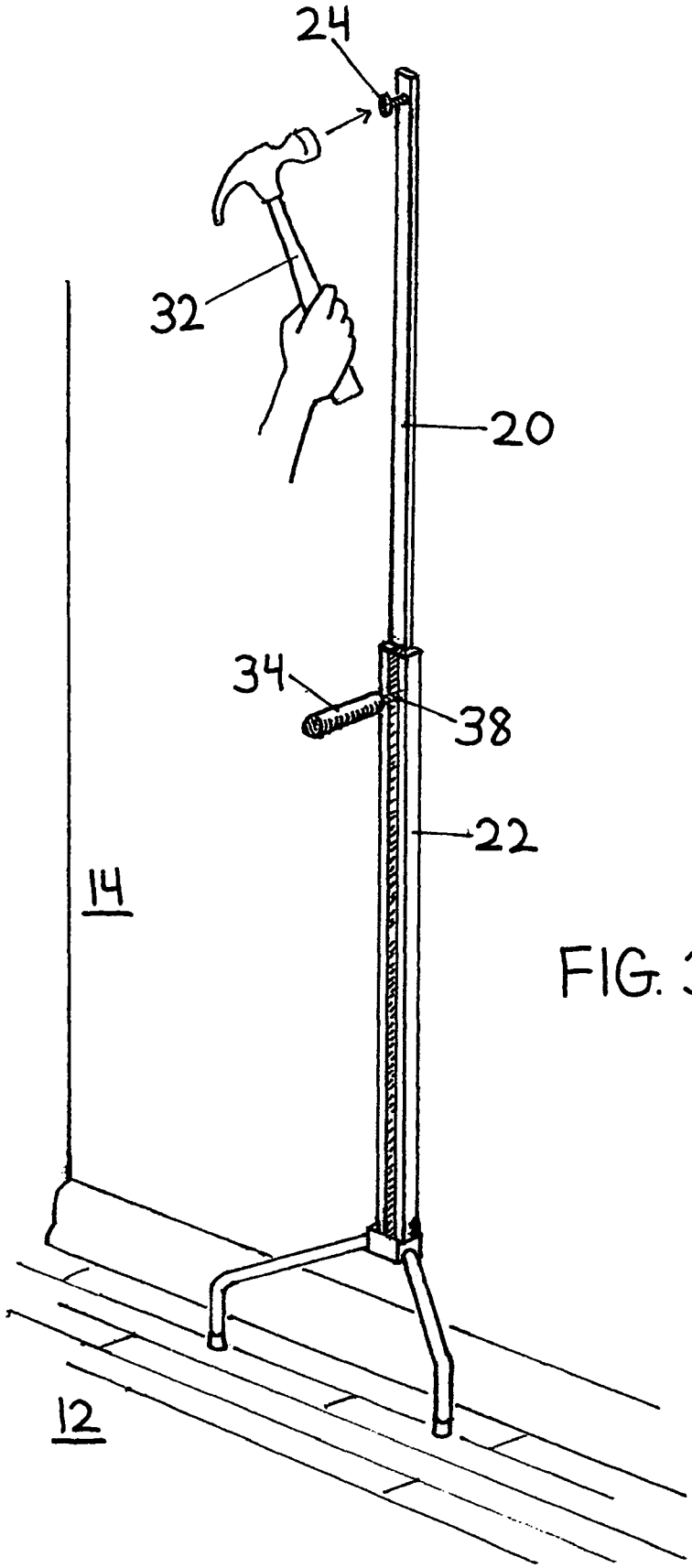
FIG. 3 is a perspective view of the device standing upright on a floor and leaning against a wall with a hammer being used to mark the location on the wall where a permanent hanger for a picture will be installed.

The device has means of locking the upper member 20 into position at a desired height so that a suspended picture can be viewed at the chosen height. In the described embodiment, the height adjustment handle 34 also serves as a mechanism for locking the vertical support in place. As shown in FIG. 3, the handle has as its end a threaded bolt 38 which is mounted in a receiving hole in the upper member. The threaded bolt extends through the upper member and may be tightened against the inside back wall of the lower member 22, whereby, when the handle is turned, the upper member is secured into position at the desired height. Other locking mechanisms may also be used such as a clamp or bracket with bolt, and may be separate from the handle.

Figure 6:
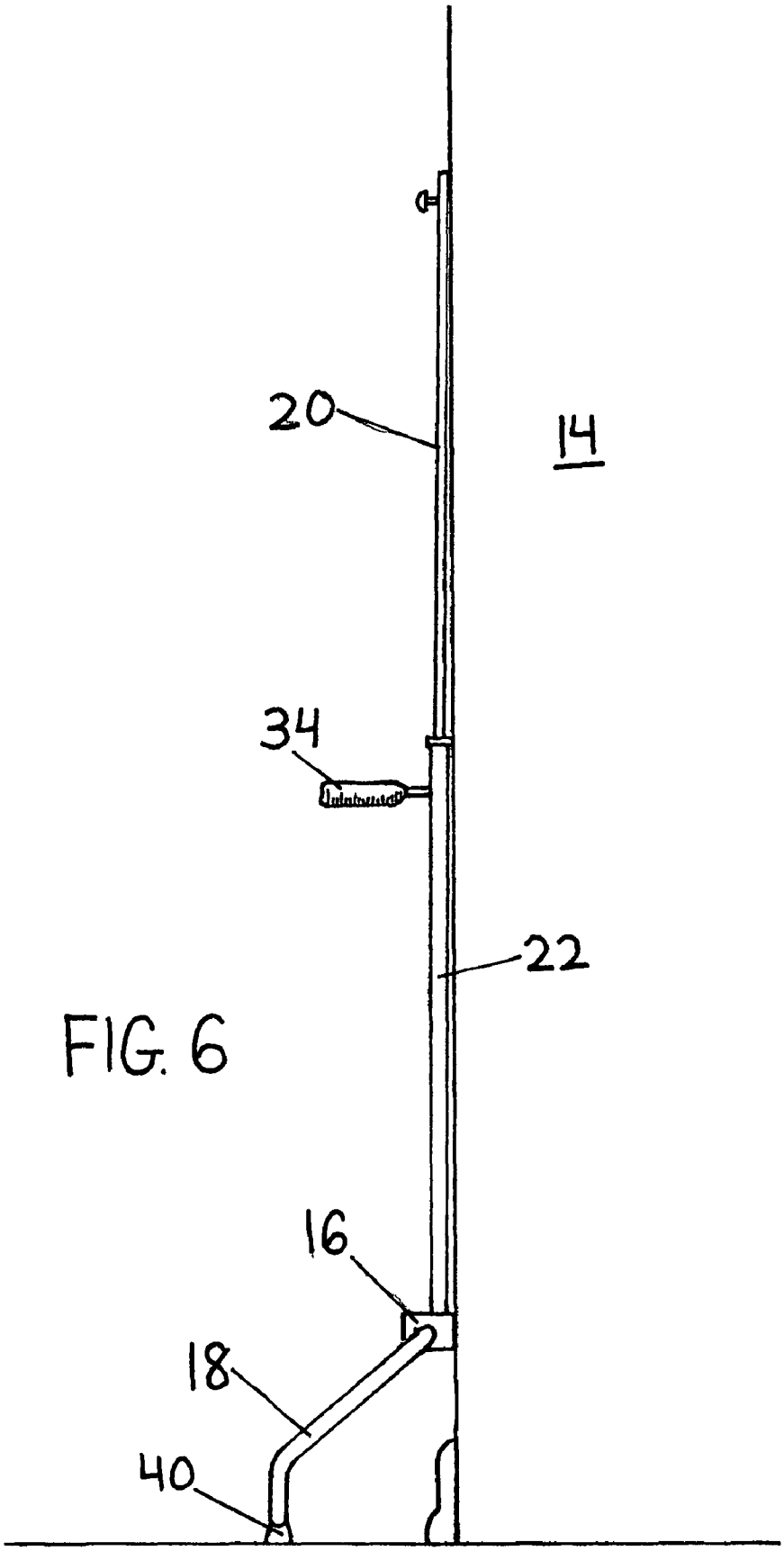
FIG. 6 is a side view of the device standing upright on a floor and leaning against wall, and showing the forward extension and elevation of the legs which allows the device to lean back against a wall.

As illustrated, the device is intended to be held upright against a wall by leaning opposite forward extending legs. The back of the vertical support is thereby held flush against the wall. The embodiment illustrated in FIG. 1 has two legs 18 extending from a base 16 which holds the vertical support. The legs extend both laterally and forward away from the supporting wall 14. As can be seen in the frontal view, FIG. 7, the legs extend a sufficient distance laterally from the base so that the device will not tip sideways. As can be seen in the side view, FIG. 6, the legs also extend a sufficient distance forward from the base such that the device remains leaning against the wall and will not tip forward, even with the added weight of a picture suspended from the upper member 20 of the vertical support. As illustrated, the legs eventually curve straight downward to the floor, so that the weight of the device is directed straight downward against the floor. Rubber end caps 40 are affixed to the bottom of the legs to provide increased friction and prevent scratching of the floor. As illustrated in FIG. 1, when the device is engaged upright against a wall 14, standing on the legs, the base 16 is raised above the floor level such that the vertical support will not be obstructed by any baseboard 42 on the wall.

With the device standing upright engaged against a wall, a picture can be suspended from the hanger on the vertical support as shown in FIG. 2, and the height can be adjusted and locked into place to allow for viewing of the picture. The device can also be moved in order to view the picture in other locations.

Once a permanent location for hanging the picture is chosen, the picture is removed, leaving the device in position. At this point the location from which the picture was suspended on the vertical support is directly in front of the point on the wall where a permanent hanger should be installed. Using this principle, the device has a means for marking the wall at the location of the hanger 24.

Figure 4:
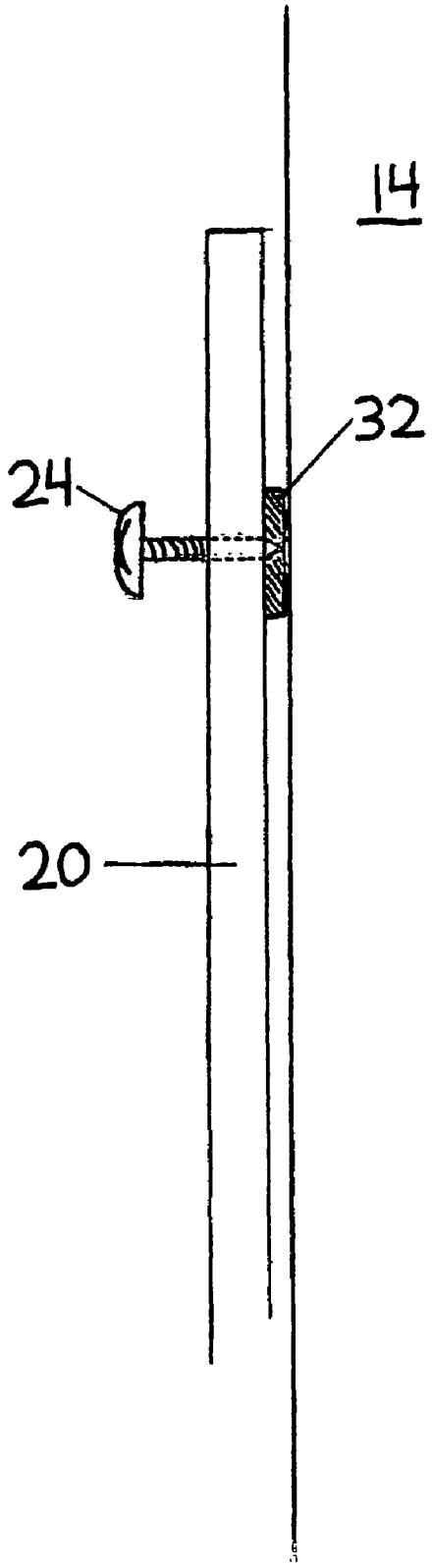
FIG. 4 is a side view of a screw serving as a hanger mounted in the upper member of the vertical support which is shown against a wall, and illustrates the sharp end of the screw to be used to mark the location on the wall where a permanent hanger will be installed, and rubber washer protecting the wall.
Figure 5:
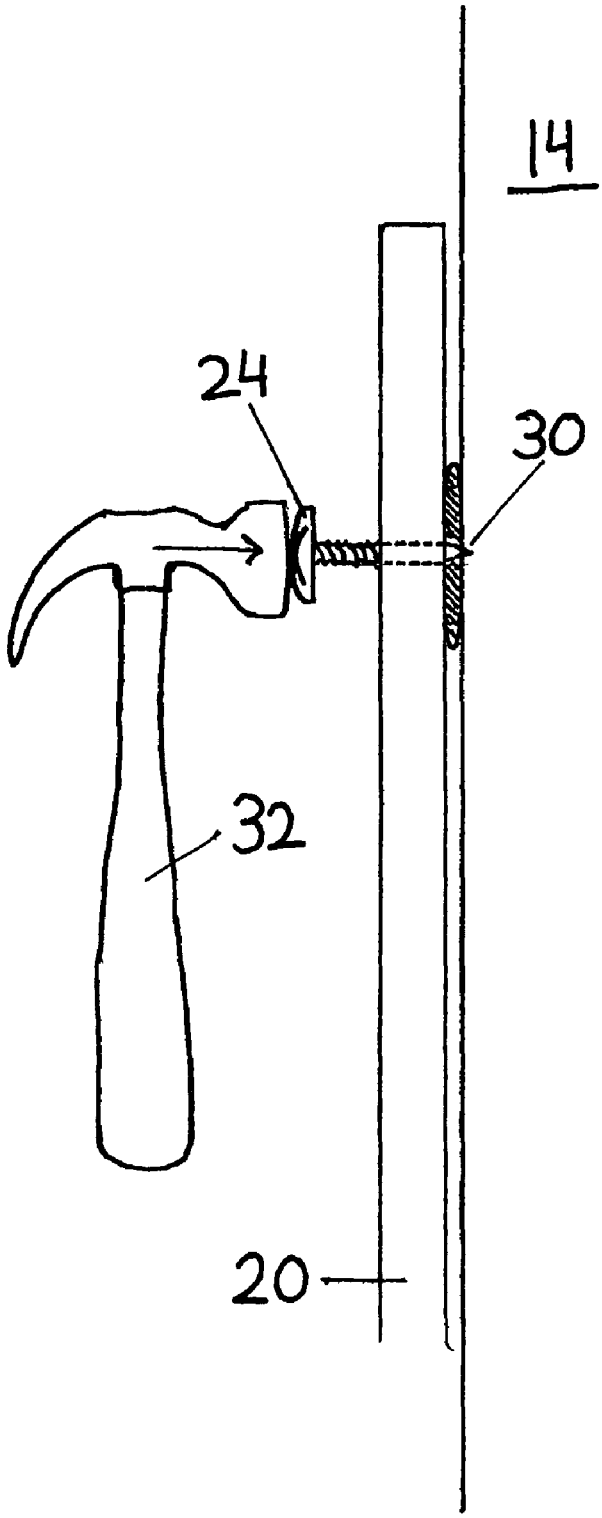
FIG. 5 is a side view of the screw from FIG. 4 with the addition of a hammer being used to tap the screw head causing the rubber washer to be compressed allowing the sharp end of the screw to mark the wall surface.

In the embodiment of the device, the hanger is a screw 24 which is mounted in a receiving hole near the top of the front face of the upper member 20 of the vertical support. As shown in FIG. 2, a picture frame wire 28 or bracket can then be seated on the screw, thereby supporting the picture. The screw will also serve as the means for marking the wall where a permanent hanger should be installed. FIG. 4 shows the screw 24 which extends through the upper member 20 and comes to a sharp point which protrudes slightly from the back of the vertical support. A rubber washer 32 can be seen affixed to the back of the vertical support to protect the wall surface from the sharp screw end. As illustrated in FIG. 5, the screw can be pushed or struck from the front, as with the hammer shown, in order to drive the sharp end 30 of the screw into the surface of the wall 14, thereby marking the wall at the location for the permanent hanger to be installed.

FIG. 4 and FIG. 5 together illustrate the rubber washer 32 used as a spring device to hold the sharp end of the screw away from the wall until the user is ready to mark the wall. In a normal state, the sharp end of the screw does not extend beyond the thickness of the rubber washer as shown in FIG. 4. As shown in FIG. 5, when the screw is pushed or tapped with a hammer from the front, the rubber washer becomes compressed allowing the screw end to strike the wall surface 14, thereby marking the wall.

Mechanisms other than the screw 24 may be employed to hold a picture suspended from the vertical support such as a hook, pin, or clasp. Also, mechanisms other than the rubber washer 32 may be used as the spring device to hold the sharp end 30 of the screw (or other marking mechanism) away from the wall such as a spring lever attached to the upper member 20.

Figure 8:
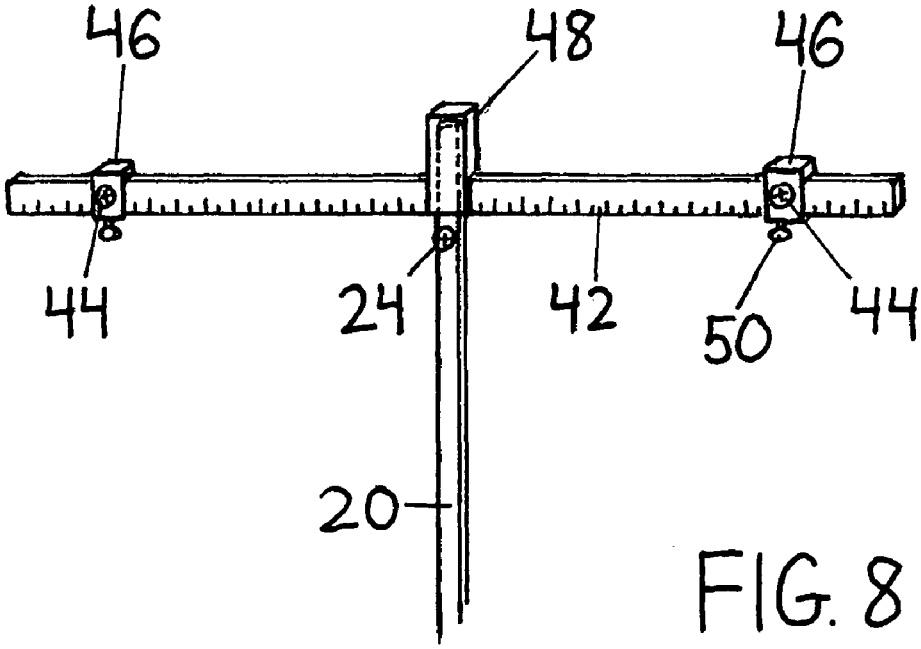
FIG. 8 is a perspective view of a horizontal member that may be attached to the top of the vertical support with a pair of sliding hanger mechanisms which allow a user to suspend a picture that requires the use of two hangers.
Figure 9:
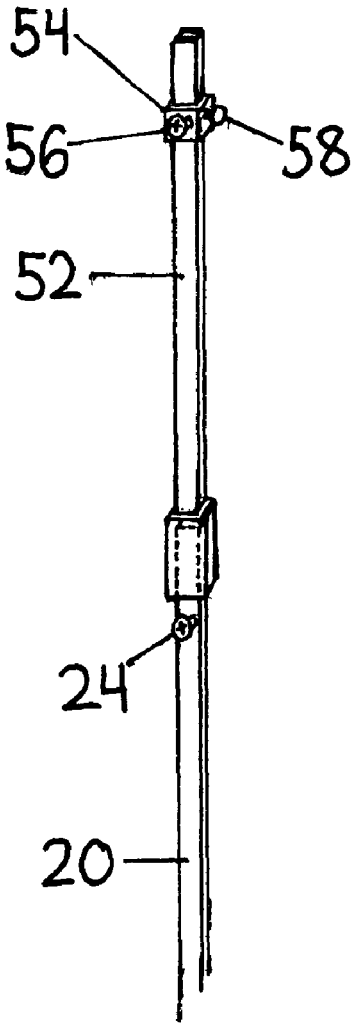
FIG. 9 is a perspective view of an additional vertical member that may be attached to the vertical support with another hanger mechanism at the top which allows a user to suspend a second picture directly over a first picture hanging from the vertical support.

As illustrated in FIG. 8, there may also be provided a horizontal member 42 which is, or can be, attached to the top of the upper member 20 of the vertical support and which contains two hangers 44, one on each side of the member. This will allow for use of the device with pictures requiring the support of two hangers, such as in the case of heavier pictures, or picture frames having brackets designed for two hangers. Each side of the horizontal member contains a bracket mechanism 46 which holds a hanger 44 and is able to slide along the length of the horizontal member, and is able to be locked into place at a desired position. As with the hanger on the original vertical support, the hanging mechanisms become the point of reference for marking the precise location where permanent hangers should be installed in the wall. The horizontal member is held in place on top of the vertical support by a bracket or sleeve 48.

The front face of each arm of the horizontal member 42 is notched or marked as in a measuring ruler. This allows the user to position the sliding hanger mechanisms 46 equal distances from the center. Each sliding hanger mechanism may be locked into place by use of a small thumbscrew 50, which tightens against the horizontal member. As with the original vertical support device, each sliding hanger mechanism has a means for marking a wall surface at the location on the wall directly behind the position of the hanger 44 from which a picture had been suspended. In the described embodiment, the marking mechanism consists of a sharp metal point mounted on the back of the sliding hanger mechanism, such that when the bracket is pushed or tapped from the front, the sharp point strikes the wall surface. Also like the marking mechanism on the original vertical support, the sliding hanger mechanisms on the horizontal member have a spring device, such as the rubber washer or spring lever, to protect the wall from being scratched by the marking mechanism prior to the time for marking the wall.

As illustrated by FIG. 8, there may also be provided an additional vertical member 52 which is detachable and can be seated on top of the upper member 20 of the original vertical support of the device by way of a bracket or sleeve. This member also has a sliding hanger mechanism 54 which holds a hanger 56, such as a screw, and can slide vertically up and down the member and be locked into position by use of a thumbscrew 58. This additional vertical member allows for a second picture to be suspended directly above a first picture suspended from the hanger on the original support. The distance between the two pictures can be adjusted by adjusting the height of the sliding hanger mechanism 54. As with the previously discussed hanger mechanisms, the position of the hanger 56 is the reference point for the location on the wall where a permanent hanger will be installed, and again, the sliding hanger mechanism has a sharp point for marking the wall directly behind the hanger from which a picture was suspended. A spring device to protect the wall is again employed.

Since certain changes may be made to the above described device not departing from the scope of the invention herein, it is intended that all matters contained in the description or shown in the accompanying drawings shall be interpreted as illustrative and not in a limiting sense.

What is claimed is:

1. A picture hanging support and wall marking device consisting essentially of:

a wall extending upwardly from a floor, said wall capable of supporting a hanging object;

a base having a rear surface resting against said wall;

at least one leg connecting to said base generally opposing said wall and biasing said base against said wall holding said base at a selected position above said floor, said leg having a distal end defining a foot spaced apart a selected distance from said wall;

an extendable vertical support member connecting to said base, said vertical support member comprising an elongated frame having a telescoping member slidably held thereto being adjustable in height said telescoping member extendable upward along said wall spaced apart therefrom;

means for removably holding selected from the group consisting of a hook, a screw, or a clasp for supporting a hanging object, said means for removably holding attaching to the top distal end of said telescoping member and extending from a front surface, a rear surface or both of said distal end;

means for marking protruding from a rear surface of said telescoping member for cooperative engagement with said wall; and means for releasably securing said telescoping member to said elongated frame at a selected position.

2. The picture hanging support of claim 1, wherein the vertical support member is held against said wall in an upright and vertical position.

3. The picture hanging support of claim 1, wherein the vertical support is vertically adjustable, having two or more members which slide together, and having a means for a user to adjust the height of the vertical support, and a means for locking the vertical support in place at a desired height.

4. The picture hanging support of claim 1, wherein said means for marking and said means for removably holding comprises a screw having a least a portion thereof extending through said telescoping member with a tip protruding therefrom for piercing said vertical surface.

5. The picture hanging support of claim 1, including a horizontal member slidably attached to a top end of the telescoping member having a hanger mechanism so for supporting a hanging object that requires the support of two hangers.

6. The picture hanging support of claim 1 ,including a second hanger mechanism to allow for the suspension of a second picture directly above a first picture which may suspended from the telescoping member and wherein the second hanger mechanism is able to slide up and down so as to adjust the height of a picture, and wherein the second sliding hanger mechanism is able to be locked into position at a desired height and wherein second hanger mechanism includes a means for marking.

7. A frame hanging support and vertical surface marking device comprising:

a vertical surface extending upwardly from a floor, said vertical surface capable of supporting a hanging object;

a base having a rear surface resting against said vertical surface;

at least two legs connecting to said base generally opposing said vertical surface and biasing said base against said vertical surface holding said base at a selected position above said floor, said at least two legs having a distal end defining a foot spaced apart a selected distance from said vertical surface;

an extendable vertical support member connecting to said base, said vertical support member comprising an elongated frame having a telescoping member slidably held thereto being adjustable in height, said telescoping member extendable upward along said wall spaced apart therefrom;

means for removably holding a hanging object attaching to a selected point near the top distal end of said telescoping member extending from a front surface and extendable from a rear surface of said telescoping member;

means for marking protruding from a rear surface of said telescoping member for cooperative engagement with said vertical surface; and means for releasably securing said telescoping member to said elongated frame at a selected position.

8. The frame hanging support and vertical surface marking device of claim 7, further including a horizontal member slidably connecting to said a top distal end of said telescoping member by means for holding, said horizontal member having at least one means for marking.

9. The frame hanging support and vertical surface marking device of claim 7, wherein said means for marking is a screw having a least a portion thereof extending through said telescoping member with a tip protruding therefrom for piercing said vertical surface.

10. The frame hanging support and vertical surface marking device of claim 7 wherein said means for releasably securing said telescoping member to said elongated frame at a selected position comprises a member being threadably secured within said telescoping member whereby said threaded member can be tightened and thus urged against said elongated frame removably locking said telescoping member against said elongated frame member.

11. The frame hanging support and vertical surface marking device of claim 7, including a spacer means removably affixed to said means for marking.

12. A frame hanging support and vertical surface marking device consisting essentially of:

a vertical surface extending upwardly from a floor, said vertical surface capable of supporting a hanging object;

a base having a rear surface resting against said vertical surface;

at least two legs connecting to and extending outwardly from said base opposing said vertical surface and biasing said base against said vertical surface holding said base at a selected position above said floor, each one of said at two least legs having a distal end defining a foot spaced apart a selected distance from said vertical surface;

an extendable vertical support member connecting to said base, said vertical support member comprising an elongated frame having a telescoping member slidably held thereto being adjustable in height, said telescoping member extending along said vertical surface spaced apart therefrom;

means for removably holding a frame attaching to a selected point near the top distal end of said telescoping member and extending from a front surface, a rear surface or both of said telescoping member;

means for marking protruding from a rear surface of said telescoping member for cooperative engagement with said vertical surface; and means for releasably securing said telescoping member to said elongated frame at a selected position.

13. The frame hanging support and vertical surface marking device of claim 12, further including a horizontal member slidably connecting to said a top distal end of said telescoping member by means for holding, said horizontal member having at least one means for marking.

14. The frame hanging support and vertical surface marking device of claim 12, including a spacer means removably affixed to said means for marking.

15. The frame hanging support and vertical surface marking device of claim 14, wherein said spacer means is a rubber washer.

16. The frame hanging support and vertical surface marking device of claim 12, wherein said frame includes a hanger comprising a rope, wire, hanger, loop, wire, and combinations thereof.

17. The frame hanging support and vertical surface marking device of claim 12, wherein said means for marking is a screw having a least a portion thereof extending through said telescoping member with a tip protruding therefrom for piercing said vertical surface.

* * * * *